United States Patent [19]

Stump

[11] Patent Number: 4,635,405

[45] Date of Patent: Jan. 13, 1987

[54] CONTINUOUS ARCUATE FEED ASSEMBLY

[75] Inventor: Lee E. Stump, Brooklyn Park, Minn.

[73] Assignee: Timesavers, Inc., Minneapolis, Minn.

[21] Appl. No.: 763,963

[22] Filed: Aug. 9, 1985

Related U.S. Application Data

[63] Continuation of Ser. No. 495,744, May 18, 1983, abandoned.

[51] Int. Cl.[4] ..... B24B 12/12

[52] U.S. Cl. ..... 51/145 T; 51/108 R

[58] Field of Search ..... 51/74, 108 R, 135 R, 51/137, 138, 139, 140, 145 T, 148, 165.78, 145 R

[56] References Cited

U.S. PATENT DOCUMENTS

| | | | |
|---|---|---|---|
| 250,455 | 12/1881 | Savage | 51/145 R |
| 763,743 | 6/1904 | Ensign | 51/145 R |
| 2,405,417 | 8/1946 | Fruth | 51/145 T |
| 2,406,728 | 8/1946 | Wharton | 51/145 R |
| 2,715,301 | 8/1955 | Kelham | 51/137 |
| 2,855,730 | 10/1958 | Ferguson | 51/145 R |
| 3,816,998 | 6/1974 | Grivna et al. | 51/216 ND X |
| 3,859,757 | 1/1975 | Heesemann | 51/138 |
| 3,888,050 | 6/1975 | Elm | 51/135 R |
| 4,038,784 | 8/1977 | Grivna | 51/139 |
| 4,258,506 | 3/1981 | Robinson | 51/138 X |
| 4,322,918 | 4/1982 | Steinback | 51/138 |
| 4,322,919 | 4/1982 | Gerber | 51/139 |

FOREIGN PATENT DOCUMENTS

| | | | |
|---|---|---|---|
| 1442101 | 7/1976 | United Kingdom | 51/145 T |

OTHER PUBLICATIONS

Timesavers Speedbelt Grinder, Model 118, Aug. 1970.
Timesavers Speedbelt Sander, 400 Series, Sep. 1974.

*Primary Examiner*—Robert P. Olszewski
*Attorney, Agent, or Firm*—Orrin M. Haugen; Thomas J. Nikolai

[57] ABSTRACT

Abrasive grinding apparatus having a continuously revolving turret assembly to which a plurality of workpiece holding platens are affixed. Associated with the turret are angularly positioned stationary grinding assemblies having drum driven abrasive belts. Work enters and leaves the grinding stations at an acute angle with intermediate, complete belt coverage, whereby necessary system drive power is minimized.

1 Claim, 4 Drawing Figures

CONTINUOUS ARCUATE FEED ASSEMBLY

This is a continuation of Ser. No. 06/495,744, filed May 18, 1983, now abandoned.

BACKGROUND OF THE INVENTION

The present invention relates to abrasive grinding apparatus and, in particular, to apparatus wherein the workpieces are continuously fed in an arcuate fashion and along an arcuate path so as to pass beneath the complete width of an orbitally driven endless abrading belt.

In the production and finishing of various metallic parts, endless abrasive belts are oftentimes used to perform various rough and finish grinding operations. Such apparatus produces parts at high production speeds with relatively accurate flat, finished dimensions and desireable surface characteristics. Exemplary applications are in the grinding of cast parts such as in the automobile industry for water pumps, transmissions, cylinder heads, etc. Such equipment also typically comprises one or more driven belts, along with associated liquid cooling and waste removal mechanisms, with such equipment being positioned relative to the work so as to perform the various desired surface grinding operations.

Most typically with such apparatus, the stationary grinding assemblies are positioned such that the workpieces pass orthogonal to the direction of travel of the abrasive belt or alternatively in line with the direction of belt travel. However, depending upon the amount of material to be abraded from each workpiece, such arrangements for large metallic workpieces are energy intensive and may require excessively large power plants, particularly when single pass operation is to be achieved.

Alternatively though if the workpieces are fed to the belt at an angle and thus exposed to the abrading belt at an angle, the actual work surface exposed at any given time is relatively small due to the averaging effect of the angulated infeed. It is therefore a primary object of the present invention to take advantage of this characteristic via a turret assembly, to which a plurality of workpiece holding platens are affixed and whereby the workpieces are rotatably passed through the apparatus where multiple operations may be accomplished, such as through exposure to "rough" grinding and "finish" grinding abrasive operations. In this fashion, the workpieces are moved continuously through the apparatus and exposed to the abrading belts at an angle which requires less overall system power than would otherwise be required.

Rotational or arcuately driven feed assemblies for various grinding apparatus have been employed previously, as for example in U.S. Pat. Nos. 2,406,728 and 2,855,730. The apparatus disclosed in each of these patents, however, is distinguishable from the present apparatus. In particular, which the U.S. Pat. No. 2,406,728 has an arcuate infeed assembly, it follows the common practice of presenting the workpiece in an orthogonal fashion to the abrading belt. U.S. Pat. No. 2,855,730 on the other hand, presents the workpiece in an angular fashion; however, it is distinguishable from the apparatus of the present invention in its structure and application.

The above objects, advantages and distinctions of the present apparatus as well as others will however, become more apparent upon a reading of the following description with respect to the following drawings.

SUMMARY OF THE INVENTION

A continious feed endless belt abrading system having an arcuate feed assembly supporting a plurality of platens to which desired workpieces are attached for exposure to one or more grinding operations. Loading and unloading of the workpieces may be accomplished either manually or through automatic equipment. Portioned about and apart from one another and relative to the feed assembly are a pair of workpiece-abrading stations, each station comprising a resiliently biased adjustable endless belt abrading mechanisms disposed relative to the path of the workpieces such that the workpieces are introduced into and exposed to the abrading surfaces of the belts at an angle relative to the belt motion. This arrangement has been found to significantly reduce system power requirements.

DESCRIPTION OF THE PREFERRED EMBODIMENT

Figure 1:
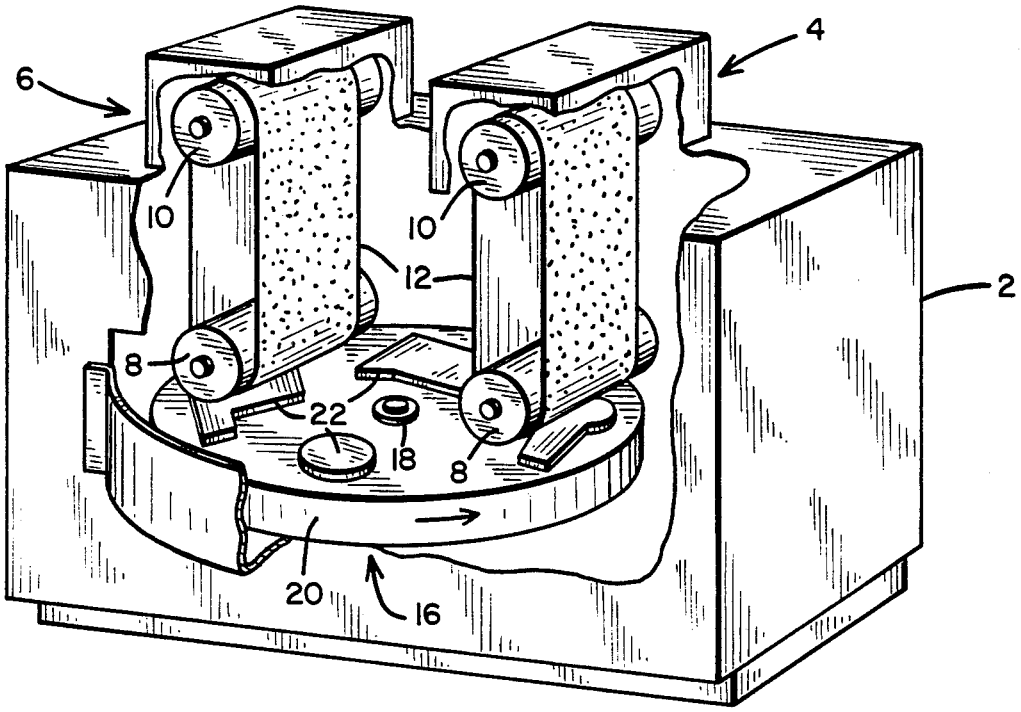
FIG. 1 is a diagramatic perspective view in partial cut-away of the abrasive grinding apparatus of the present invention, with the belt drive and control systems being removed from the assemblies.

Referring to FIG. 1, a generalized perspective view is shown of the present apparatus and the relative positioning of its primary components. In this regards, the apparatus is generally comprised of a cabinet 2 which contains a "rough" endless belt grinding assembly 4 and a "finish" endless belt grinding assembly 6. Each grinding assembly comprises a driven lower contact drum 8, an upper idler drum 10 and an abrading belt 12. The belts 12 typically have an abrasive grit selected for the material of construction of the work and the nature of the operation, such as a coarse grit for rough work and a finer abrasive grit for finish work. Each belt also typically is 5 to 50 inches wide sufficiently to handle the operation selected. The grinding assemblies 4 and 6 are, in turn, driven via associated drive motors (not shown) which are positioned on the respective right and left sides of the cabinet 2 and which are coupled to the grinding assemblies 4 and 6 via associated drive pulleys and belt mechanisms.

Positioned beneath the grinding assemblies 4 and 6 is a work piece supporting turret assembly 16 which revolves about a center axis 18 via an appropriate drive mechanism and motor (not shown). Attached to the table 20 of the assembly 16 are a plurality of platens 22 of various desired shapes and sizes and having various indexing holes and pegs formed therein for subsequent alignment with various types of work pieces that will be mounted thereto such turret assemblies are known in the art.

Thus, upon mounting the workpieces to the platens at an infeed station, the platens are revolved so as to bring the workpieces first beneath the rough grinding assembly 4 and then beneath the finish grinding assembly 6, after which the workpiece is removed at the outfeed station. It should be noted too that a coolant (typically water) is supplied to the drums of the individual grinding assemblies 4 and 6 via a coolant inlet port continued on the back of the cabinet 2 and sprayed on the work pieces during normal operation so as to cool the abrasive belts 12 and workpieces. Also and not shown, the cabinet 2 contains associated waste removal apparatus for collecting the waste water and material abrasively removed from the workpieces so as not to unduly contaminate the grinding operations of subsequently treated workpieces. It is should also be noted that typically spaced about the periphery of the table 20 are mounted a number of safety switches (not shown) for detecting positions, including the elevation and radial positions of the workpieces as well as a part gauge for detecting the extent of abrasive belt wear.

Figure 2:
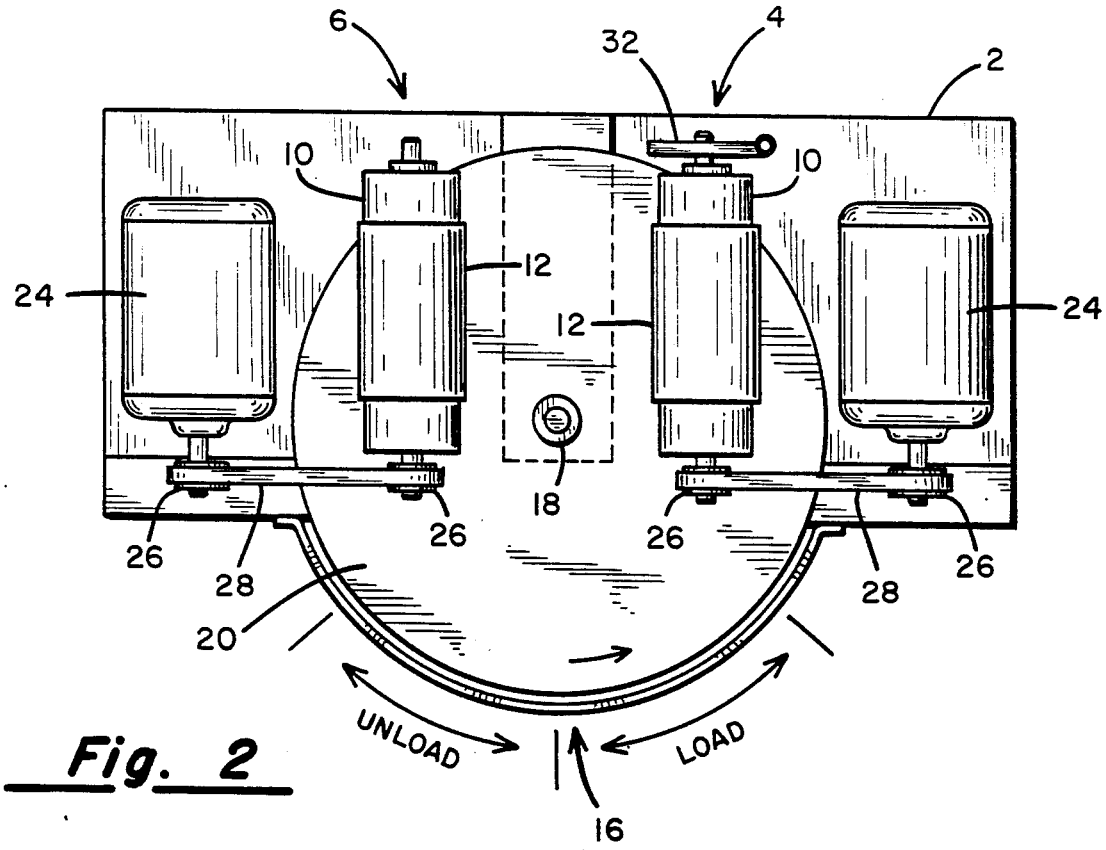
FIG. 2 is a top view of the apparatus illustrated in FIG. 1, and showing the normal positioning of the grinding heads relative to the rotating infeed assembly.

Referring next to FIG. 2, a generalized top view is shown of the apparatus and the relative positioning of the grinding assemblies 4 and 6 with respect to the rotating turret 16. From this figure, the grinding assembly drive motors 24 and associated V-belt drive pulleys 26 and V-belts 28 can more readily be seen. More particularly though, it is to be recognized that as the workpiece containing platens 22 move on their arcuate paths along with turret table 20, they initially meet and pass under the abrading belts 12 at an acute angle, which angle gradually changes as the work is rotated through its path and exposed to the surface of the belt. Thus, the work enters along the bias relative to the path or axis of the abrasive belt 12 so as to incrementally expose more and more surface area of the workpiece to the belt as the work passes thereunder. For the present embodiment, it has been determined that when abrading approximately 0.100 inches from aluminum or iron castings of approximately 60 square inches, an initial acute angle of 15 degrees to 60 degrees is preferred in that the horsepower requirements of the drive motors 24 can be reduced from about 65 horsepower to about 50 horsepower. Such a power reduction is further significant in that significant costs are saved not only from the initial purchase, but also over a span of time, due to the reduced power demands.

Figure 3:
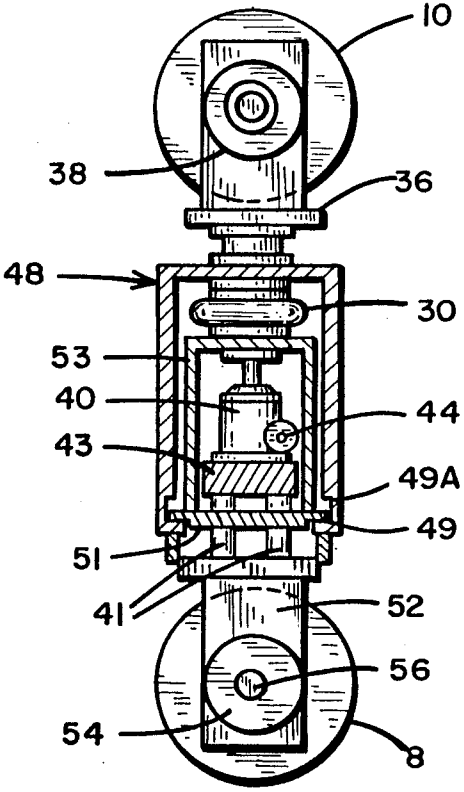
FIG. 3 is a side view, partially broken away, of a typical grinding assembly for use in the apparatus of FIGS. 1 and 2.

Referring next to FIG. 3, a partially cut-away and sectioned end view is shown of a typical grinding head assembly, such as illustrated at 4 and 6 in FIG. 1, with this figure illustrating the detail of the adjusting mechanism utilized in the head assembly. In addition to the contact drum 8 and idler drum 10, each assembly is comprised of an intermediate extendable air cylinder 34 used to properly tension the endless abrasive belt.

Figure 4:
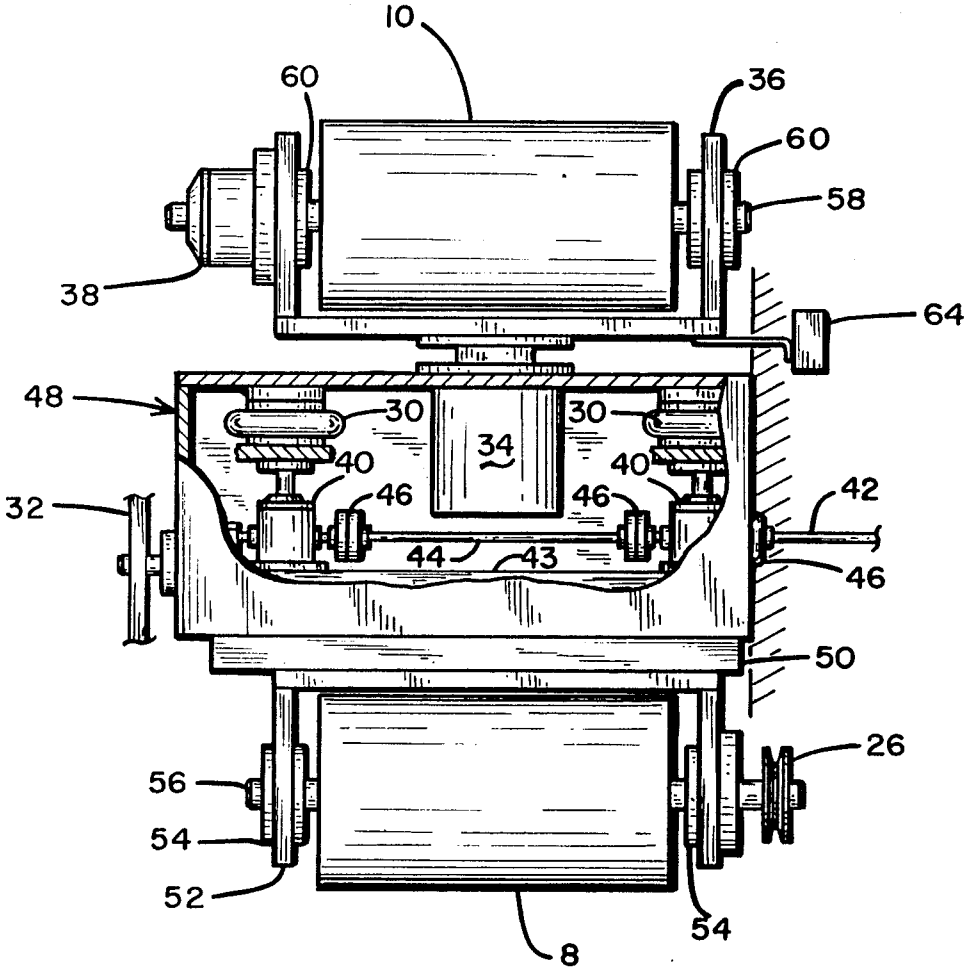
FIG. 4 is a front view, partially broken away, of the grinding assembly illustrated in FIG. 3.

With continuing reference to FIG. 3, and also with reference to FIG. 4, the contact drum 8 may be adjusted either upwardly or downwardly in relative position from the center bar 48 via two screw-jacks 40, with drum 8 being laterally guided via four individual guide posts (not shown). The screw-jacks 40 operate concurrently, or cooperatively via couplings 46 and jack-shaft 42 and 44.

Normally, controlled adjustment of contact drum 8 is required in order to change and/or establish the grinding plane of that head independently of the grinding plane of the other grinding heads of the overall apparatus. For example, the first grinding head is normally set with its grinding plane contacting the work to establish a rough dimension, with the grinding plane of the second grinding head being established to remove a modest amount of additional material to provide the work with a finished part dimension. In the embodiments illustrated in FIGS. 1 and 2, the first grinding head is included in assembly generally designated 4, with the finish grinding being accomplished by the grinding head included in assembly generally designated 6.

Air bladders are included in the adjustment system, with such bladders being shown at 30—30. These air bladders function as a machine overload protection device. The force created by the air bladders hold the drum guide and assembly in place against a positive stop. This arrangement provides a means for holding the contact drum 8 on or along the pre-established or desired grinding plane.

In FIG. 3, the positive stop is illustrated at 49, which is the ledge or lower-most surface of the groove 49A formed in center bar 48. Plate 51, which is coupled to the open-end edges of inverted channel 53 forms a box-like support frame for applying normal grinding force to the grinding head, while at the same time providing overload protection in the event of an overly thick or mis-fixtured part passing under the drum. In such an event, the box-arrangement consisting of plate 51 and channel 53 will raise upwardly off of stop surface 49, thus achieving overload protection for the machine. It may be seen, therefore, that air bladder 30 is provided to hold the entire adjusting unit downwardly against stop 49.

The vertical adjustment for establishing the grinding plane for drum 8 is obtained with adjustable screw-jacks 40—40. Thus, jacks 40 along with guide posts 41—41 which are coupled thereto by means of plate 43 are utilized to establish the vertical elevation or disposition of drum 8.

When a plurality of screw-jacks such as screw-jacks 40 are utilized, it may be desirable to gang the jack shafts together, such as jack shafts 42 and links 46 so as to achieve equal motion on the individual jack shafts. Such an arrangement expedites change-over, as well as providing a means for maintaining control of the grinding plane. It should also be noted that an appropriate bracket 52 supports the bearings 54 and axle shaft 56 of the lower contact drum. Similarly, an axle 58 and bearings 60 rotatably support the idler drum 10.

The air pressure maintained in bladders 30 is regulated and maintained remotely. The force created by the bladders 30—30 determines the available grinding force. Should an excessive grinding pressure be encountered, the bladder will accomplish relief by permitting contact drum 8 to rise, thereby preventing over-stress or overload conditions from occurring on the machine.

The brake 38 is provided for use in emergency situations, and achieves emergency stops when appropriate. Brake 38 is activated by the machine operator pushing or energizing the emergency stop button, or automatically in the event the abrasive belt should sever or move too far out of its normal operating path. In the event of a fracture of the abrasive belt, idler drum 10 would normally continue to rotate for an extended period of time due to inertia forces alone. In order to reduce the time required for installation of a fresh abrasive belt, brake 38 is energized automatically when the system senses that an abrasive belt has ruptured, separated, or broken, or is not found in its normal operating path or position.

With attention being briefly directed to FIG. 2 of the drawings, bracket 32 is an outboard support bracket used to stabilize the grinding head while grinding is occurring, and to prevent the grinding head from deflecting upwardly and laterally in response to forces created by the normal resistance to the grinding load. This support may be defined as a swing support, and is normally hingedly secured, as indicated, to permit the support to be removably positioned to permit abrasive belt loading.

In operation, power is applied to the lower contact drum 8 and axle shaft 56 via the associated drive motor 24 and the pulley sheave 26 attached fast on axle shaft 56. Thus, as the contact drum 8 rotates it causes the abrasive belt 12 to remove the desired thickness of material from the workpiece. A self-center tracking assembly 64 associated with the idler drum 10, also permits the apparatus to electronically monitor the belt position relative to the drums 8 and 10 so that it remains centered. Electrical belt-tracking systems are commercially available.

While the present invention has been described with respect to its various preferred components and configuration, it is to be recognized that various modifications may be made without departing from the scope of the presently described invention. It is therefore contemplated that the following claims should be interpreted in conjunction with the present description to include all such equivalent structures.

What is claimed is:

1. An endless abrasive belt grinding assembly comprising:

(a) first and second driven endless abrasive belt grinders, wherein each grinder comprises:

(1) frame means;

(2) a lower driven contact drum and an upper idler drum operatively retained within said frame means to form a working drum pair and with said contact drum being adapted for rotatable motion about the central axis thereof;

(3) an endless abrasive belt having a longitudinal axis and being wrapped about each said working drum pair and arranged for travel along the direction of said longitudinal axis, with said longitudinal belt axis being generally normal to the central axis of the lower contact drum of said working drum pair;

(4) screw-jack means coupled to said frame means and disposed intermediate said contact drum and said idler drum for adjustably positioning said contact drum to establish the grinding plane of said abrasive belt; and (5) air-filled bladder means operatively and resiliently coupling said contact drum to said frame means for applying a substantially continuous bias force against said contact drum as it engages workpieces passing along said grinding plane thereunder;

(6) a circular rotating table having a centrally disposed axis of rotation, means for rotating said table at a substantially continuous arcuate rate of speed, and with a plurality of work-retaining platens thereon, each platen being disposed on said rotating table in radially spaced relationship to said axis of rotation and being arranged to move along a closed circular path at said substantially continuous rate of speed, and said work-retaining platens being further adapted to receive and support at least one workpiece thereon for arcuately conveying said workpiece on said rotating table along said circular path and immediately beneath the contact roll of each of said working drum pairs within said grinding assemblies to create a working line of contact between said abrasive belt and the surface of said workpiece and thereby remove a desired amount of material from the thickness of said workpiece; and (7) the central axis of rotation of the lower contact drum of each working drum pair being disposed and positioned relative to the surface of said rotating table and to the arcuately moving workpieces secured thereto such that the angular relationship between the contact drum central axis of rotation and the direction of motion of the work-retaining platen at the point where said work retaining platen moves directly beneath said central axis of rotation and along said closed circular path ranges from between about 15 degrees and 60 degrees.

* * * * *